US006912955B2

(12) United States Patent
Invernizzi et al.

(10) Patent No.: US 6,912,955 B2
(45) Date of Patent: Jul. 5, 2005

(54) METAL-BACKED PRINTING BLANKET

(75) Inventors: Gianpietro Invernizzi, Lodi (IT); Silvia Bergamaschi, Lodivecchio (IT); Fausto Zeni, Sccugnago (IT)

(73) Assignee: Reeves Brothers, Inc., Spartanburg, SC (US)

( * ) Notice: Subject to any disclaimer, the term of this patent is extended or adjusted under 35 U.S.C. 154(b) by 0 days.

(21) Appl. No.: 10/645,106

(22) Filed: Aug. 21, 2003

(65) Prior Publication Data

US 2005/0039619 A1 Feb. 24, 2005

(51) Int. Cl.[7] ..... B41N 10/04
(52) U.S. Cl. ..... 101/376; 101/375
(58) Field of Search ..... 101/375, 376, 101/415.1; 428/909

(56) References Cited

U.S. PATENT DOCUMENTS 3,705,072 A * 12/1972 Rosvold ..... 428/354
4,793,041 A * 12/1988 Jenkins et al. ..... 492/37
5,347,927 A * 9/1994 Berna et al. ..... 101/401.1
5,749,298 A * 5/1998 Castelli et al. ..... 101/415.1
5,941,172 A * 8/1999 Brookfield ..... 101/379
2003/0045646 A1 * 3/2003 Buono et al. ..... 525/329.1
2003/0116044 A1 * 6/2003 Buono et al. ..... 101/395

* cited by examiner

*Primary Examiner*—Daniel J. Colilla
(74) *Attorney, Agent, or Firm*—Dougherty, Clements & Hofer

(57) ABSTRACT

A metal backed printing blanket for mounting on a blanket cylinder that includes a gap, the printing blanket having a thin metal base plate with top and bottom surfaces and ends which include leading and trailing edges adapted for engaging the gap in the cylinder; a compressible, elastomeric printing blanket secured to the top surface of the base plate but not the ends and having an upper face adapted for contact transfer of ink to a printable substrate; and a specialized coating applied to the bottom surface to prevent deformation of the printing blanket and to prevent delamination of the printing blanket from a blanket cylinder. The method for making a metal backed printing blanket for mounting on such a cylinder is also disclosed.

16 Claims, 5 Drawing Sheets

METAL-BACKED PRINTING BLANKET

BACKGROUND OF THE INVENTION

This invention relates to a printing blanket construction, and more particularly to a metal backed printing blanket construction having a specialized corrosion resistant treatment that is attached to the underside (or reverse) of the metal blanket. The type of blanket referred to herein is used primarily in offset lithographic printing, but may also find utility in other fields of printing.

In offset lithography, a rotary cylinder is covered with a printing plate that normally has a positive image area receptive to oil-based inks and repellent to water and a background area where the opposite is true. The printing plate is rotated so that its surface contacts a second cylinder covered with a rubber-surfaced ink-receptive printing blanket. The ink present on the image surface of the printing plate transfers, or offsets, to the surface of the blanket. Paper or other sheet stock to be printed is then passed between the blanket-covered cylinder and a rigid back-up cylinder to transfer the image from the surface of the blanket to the paper.

One common type of printing blanket is typically manufactured as a flat, fabric sheet with an elastomeric surface that is receptive to ink. Such a blanket is mounted by wrapping it around the blanket cylinder. Various means are used to secure the blanket to the cylinder. Typically, the cylinder has a relatively wide gap or groove in its surface (referred to herein as "the cylinder gap"), running in the axial direction, and the leading and trailing ends of the printing blanket are inserted into the gap and secured by any one of a variety of holding devices. Such devices include reel rods and lock-up mechanisms (see, e.g., U.S. Pat. No. 4,870,901 to Norkus), bar supports (see, e.g., U.S. Pat. No. 4,092,923 to Bollmer) and clamps (see, e.g., U.S. Pat. No. 5,329,853 to Dilling and Stegmeir) adapted to grip the ends of the blanket that are inserted into the cylinder gap. The leading and trailing edges of such blankets are generally reinforced with strips of metal, known as "blanket bars", to stiffen the blanket edges and to facilitate insertion of the blanket into the holding device inside the cylinder gap (see, e.g., U.S. Pat. No. 4,090,444 to Stearns).

A metal-backed printing blanket typically comprises a base layer of a thin, flat, flexible sheet of metal and a top layer comprising an elastomer such as rubber. Other layers may be sandwiched between the base and top layers, formed of materials such as fabric, after which these multiple layers are laminated together. Such a blanket conventionally has a thickness of about 2 mm, of which about 0.20 mm may be attributed to the thickness of the metal base plate. One configuration of a metal-backed blanket manufactured and sold by KBA (Koenig & Bauer-Albert AG, of Frankenthal, Germany) has a small strip of exposed metal at the leading and trailing edges of the blanket adapted for insertion into the cylinder gap. See, e.g., Puschnerat et al, U.S. Pat. Nos. 5,687,648 and 5,934,194. See also Castelli et al, U.S. Pat. No. 5,749,298.

During the step in which the image is transferred from the plate to the blanket and the step where the image is transferred from the printing blanket to the paper, it is important to have intimate contact between the two contacting surfaces. This is ordinarily achieved by positioning the blanket-covered cylinder and the supporting cylinder it contacts so that there is a fixed interference between the two so that the blanket is compressed throughout the run to a fixed depth, typically approximately 0.002 to 0.006 inches. It is important that this compression be maintained uniformly over the entire surface of the blanket.

Conventionally, this fixed interference is accomplished by inserting one or more thin layers of paper or the like between the blanket and the surface of the cylinder to build up the thickness of the blanket. This process is known as packing a blanket. This process presents problems however in that the packing procedure is time consuming, resulting in down time for the printing equipment. Further, once positioned on the cylinder, the packing paper tends to slide, slip, and/or fold which may render the blanket surface nonuniform and resulting in poor printing results. Further, when a blanket must be replaced, the time consuming packing operation must be repeated for a new blanket.

So-called "no pack" blankets have been developed to provide a fixed interference without the need to pack the blanket. No pack blankets are manufactured to very precise gauges so that one can be installed directly onto a cylinder with the correct amount of interference. These blankets have the advantage of a one-piece construction which requires no positioning of packing paper beneath the blanket. This results in less down time for the printing equipment when an old blanket is removed and replaced with a new blanket.

Such no pack blankets, like most printing blankets, are normally composed of a base material which gives the blanket dimensional stability. Presently most, if not all, commercial printing blankets use woven fabrics for the base material. The base may consist of one or more layers of such fabric. The working surface of the blanket which contacts the ink is typically an elastomeric layer of natural or synthetic rubber which is applied over the base layer or layers. The base layer or layers and working surface are laminated together using suitable adhesives.

In offset lithography as well as other printing operations, the printing plate and blanket cylinders are subject to corrosion and rust because of exposure to inks, water, and chemicals used in cleaning up the machinery. To combat such problems, these cylinders have typically been plated with chrome or nickel, as disclosed in U.S. Pat. No. 5,366,799 issued to Pinkston et al. These metals provide a surface that is not only corrosion resistant, but also ink repellent.

However, such nickel- and chrome-plated cylinders have not worked well in conjunction with no pack blankets. After only short periods of use, nickel is removed from the cylinder surface to such an extent that uncoated steel is exposed. While chrome plating is more resistant to removal than nickel, it too is subject to wear. The areas on the cylinder surface where the plated metal is removed are then subject to rapid corrosion and/or oxidation. Some have speculated that the nickel or chrome is removed by corrosion from chemicals which wick around the edges of the printing blanket. Others have speculated that the metal removal is caused by electrical charges building up from the friction between the blanket and cylinder.

An alternative to using nickel- or chrome-plated cylinders is to coat the printing blanket or the cylinder surface with a plastic adhesive foil, such as polyester. This is done by gluing the adhesive foil to the cylinder's surface, or alternatively, directly to the back of the metal backed blanket. These adhesive foils have the many of the same protective characteristics of the metal plated cylinders, but do not experience the degree of corrosion and oxidation that the metal plates are subject to.

These adhesive foil coatings are not without problems. Exposure to the same inks, water, and chemicals that cause the corrosion/oxidation problems in the metal plated cylinders can cause bubbles to form between the polyester film, and the surface of the cylinder. These solvents penetrate the foil coating from either side of the cylinder, resulting in the bubbling and delamination of the foil coating.

An important goal in offset printing is to increase the operating speeds of printing presses in order to maximize production. However, flaws and imbalances in the printing blanket become magnified as the rotational speed of the blanket cylinder is increased. In particular, high-speed rotation of a cylinder with a cylinder gap can result in undesirable levels of vibration and shock loading. Bubbling and delaminating as described above causes the weight of the cylinder to be unevenly distributed about its axis. The resultant eccentric loading increases vibration during high-speed rotation of the cylinder, to the detriment of print quality. Fabric backed printing blankets are particularly susceptible to the deleterious effects of vibrations during high speed operations, such as slipping and smearing of ink as it is transferred from one surface to another.

Furthermore, high-speed operations increase shock loading, which occurs when the edges of the gap contact the adjoining printing plate. This repetitive impact causes the cylinder and the mounted blanket to bounce, causing the ink to streak and increasing wear on both the blanket and the cylinder.

Thus, it is desirable to create a coating for blanket cylinders that does not experience the drawbacks that are seen with the current plastic adhesive foils, or the metal-plated cylinders. Therefore, there exists a need in the art for a no-pac blanket that can prevent corrosion of the blanket cylinder without resulting in lengthy downtime of the machine, or a drop off in the print quality due to bubble formation.

SUMMARY OF THE INVENTION

The above-identified problems have been solved by eliminating the plastic adhesive foil and other packing of the metal backed blanket. Cleaning solvents and other commonly used printing chemicals do not form bubbles underneath the printing blanket when the blanket is applied directly to the blanket cylinder. To prevent the corrosion that would otherwise take place, the blanket cylinder contact surface of the metal backed blanket is specially treated. This treatment takes the place of the packing in the prevention of slippage of the belt around the drum, and also prevents corrosion of the drum due to application of the solvents, adhesives, and other chemicals. Unlike the packing materials of the prior art, the special backside treatment of the current invention does not bubble when it comes in contact with the adhesives and solvents that are used in the application of the metal-backed blanket to the drum. Pretreating the metal backed blanket with the specialized treatment reduces the downtime, and the complexity of replacing the printing blanket.

The specialized treatment applied to the metal backed blanket can be a very thin plastic film. The film is applied to the metal backed blanket in such a manner as to prevent the absorption of adhesives, solvents, and other printing chemicals by the metal backed blanket. This can be accomplished by thermowelding, plastic spray on techniques, plasma treatment, or any other method that is known in the art. The film is generally applied in a thickness of from 5 to 250 $\mu$m, preferably from 5 to 100 $\mu$m, and optimally from 25 to 100 $\mu$m. The plastic adhesive foil can be made from such materials as polyolefins, polyesters, polyurethanes, phenolic compounds, polyethylene, polystyrene, polypropylene, polymethyl methacrylat,e polyamides, nylon, polyvinyl chloride, polyvinyl fluoride, or the like.

When the specialized coating is thermowelded to the metal backed blanket, the foil prefereably has a thickness of from 10 to 250 $\mu$m. The thermowelded foil is preferably comprised of polyurethane, polyolefin, phenolic compounds, nylon, polyvinyl chloride, polyvinyl fluoride and the like.

When the specialized coating is applied by coating or spraying a film of solvent and abrasion resistant material, the coating has a preferred thickness of from 5 to 50 $\mu$m. The spray on film is preferably comprised of polyvinyl fluoride (PVF), polytetrafluoroethylene (PTFE), polytetraethylene (PTE), epoxy resins, phenolic resins, and nylon resins.

Finally, the specialized treatment can be applied by way of plasma treating the metal backed blanket with silicon carbide or aluminum oxide. In this embodiment, the treatment is applied to a thickness of from 5 to 25 $\mu$m.

Even though there is no longer and packing material, the total metal backed blanket thickness remains in the range of from 1.40 to 2.30 mm. This is beneficial, since the preferred blanket thicknesses for commercial presses are 1.65 to 2.15 mm, and preferred blanket thicknesses are from 1.65 to 2.30 mm for newspaper presses.

BRIEF DESCRIPTION OF THE DRAWINGS

The present invention will be more readily understood by reference to the accompanying drawing figures that represent three different possible blanket structures and the orientation of the compressible layer relative to the other layers which are provided by way of non-limiting example and in which.

DETAILED DESCRIPTION OF THE PREFERRED EMBODIMENTS

Figure 1:
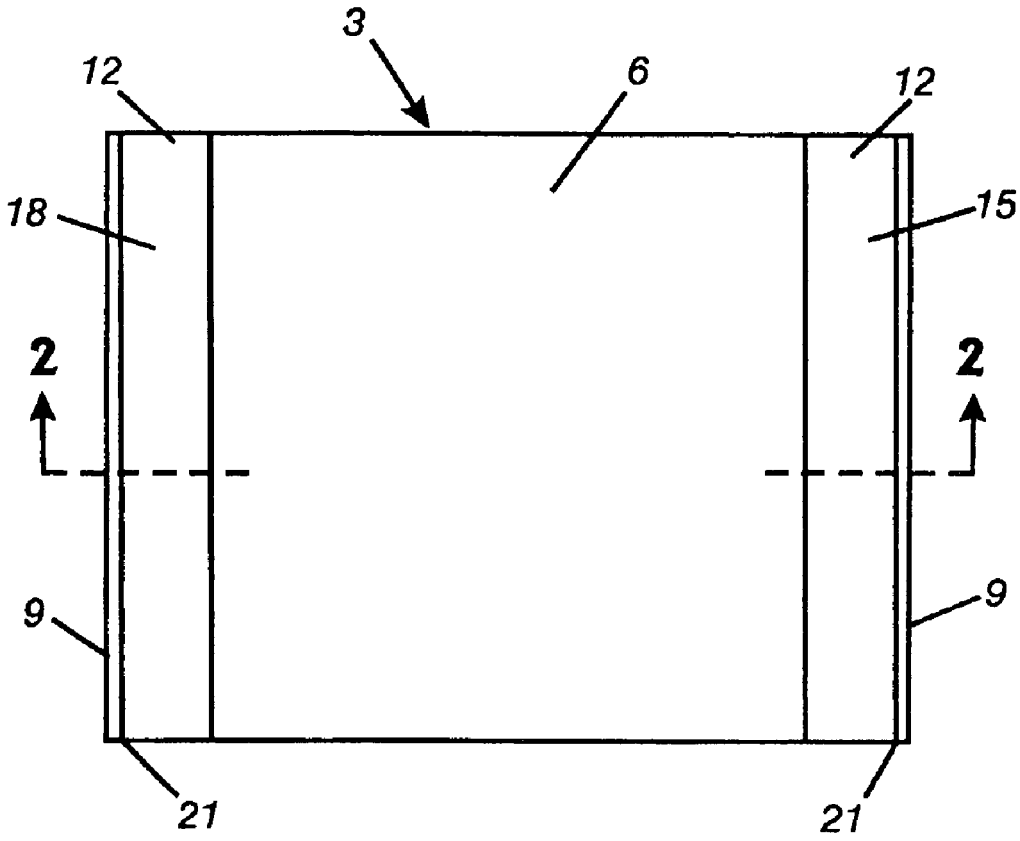
FIG. 1 is a top view of the invented printing blanket lying completely flat.
Figure 2:
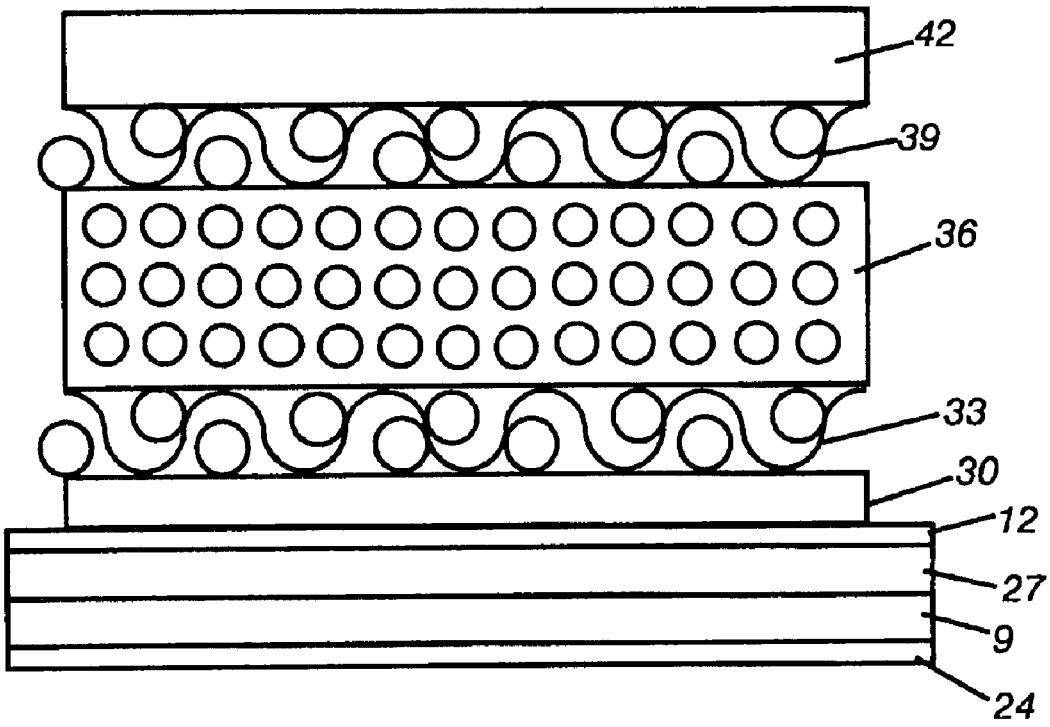
FIG. 2 is an enlarged cross-sectional view of a metal backed blanket according to the invention, taken along section line 2—2 of FIG. 1. The compressible layer could be placed close to the metal adhesive layer with two fabric layers close together just under the printing face.
Figure 3:
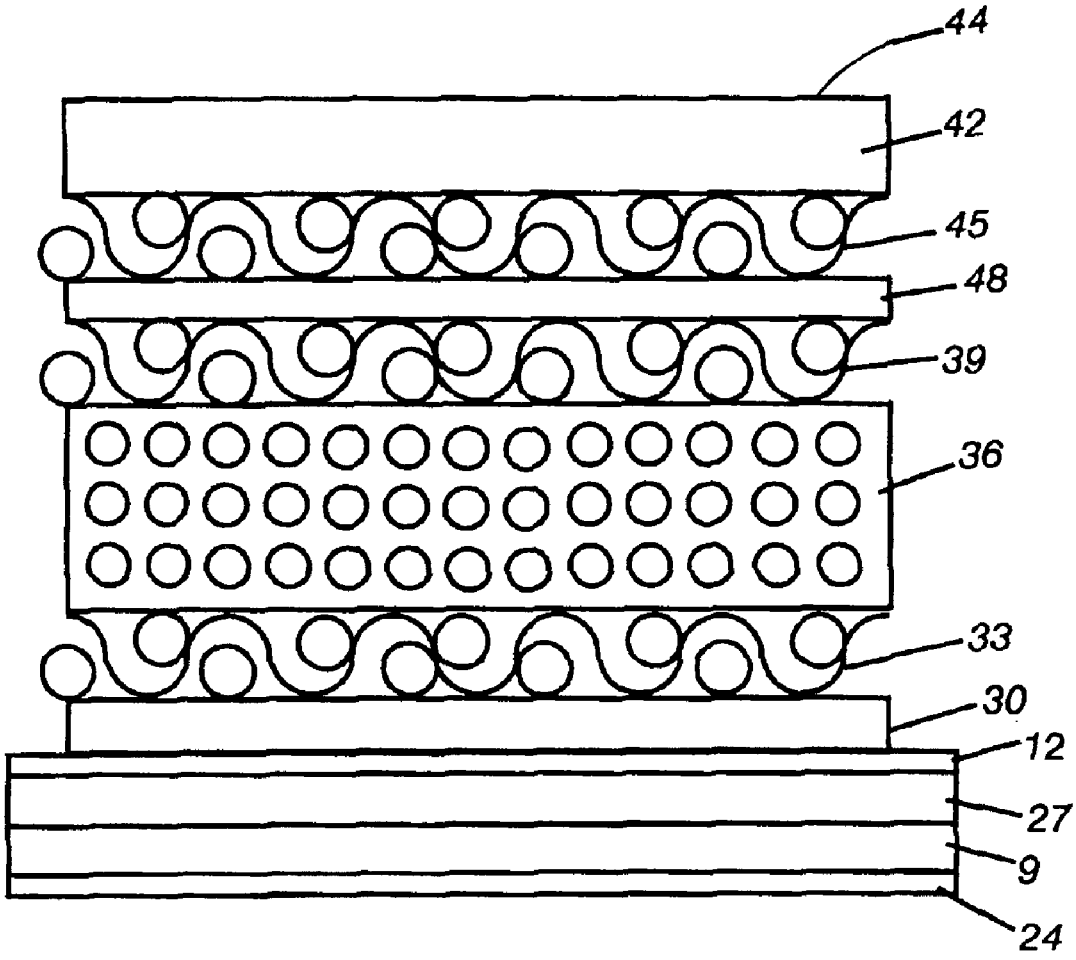
FIG. 3 is an enlarged cross-sectional view of a metal backed blanket in accordance with a preferred embodiment of the present invention. The position of the compressible layer could also be close to the adhesive layer (close to the metal) and between the first and the second fabric layers.
Figure 4:
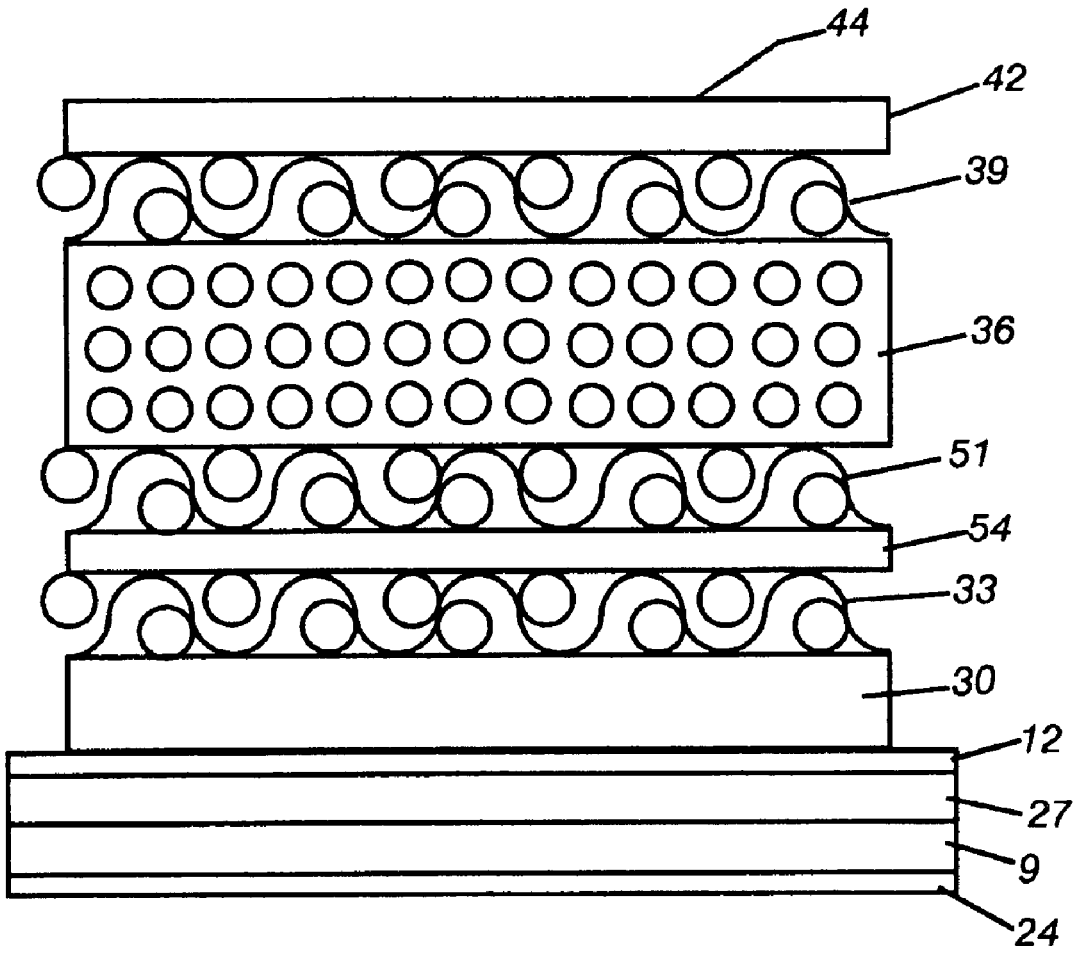
FIG. 4 is an enlarged cross-sectional view of a metal backed blanket in accordance with another embodiment of the present invention. The position of the compressible layer could also be close to the adhesive layer (printing face) and between the second and the third fabric layers.
Figure 5:
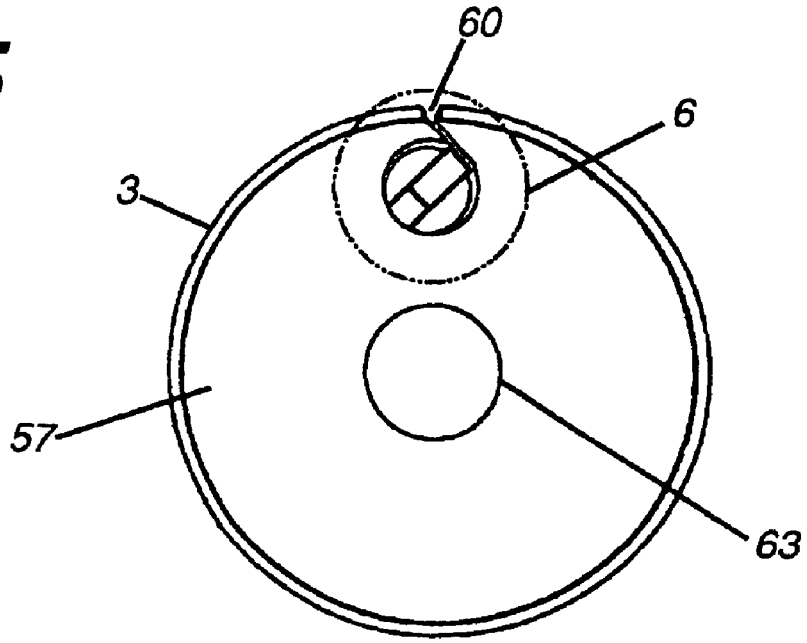
FIG. 5 is a schematic view of the printing blanket mounted on a cylinder having a cylinder gap.
Figure 6:
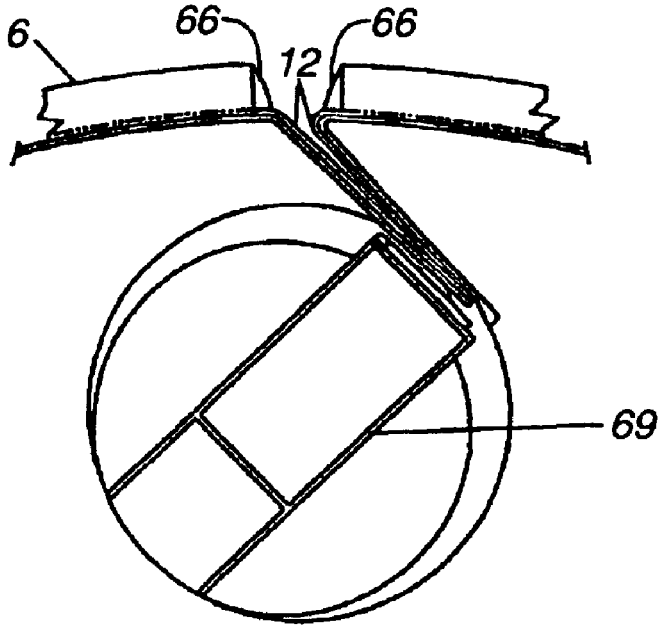
FIG. 6 is an enlarged cross-sectional detail view of a portion of FIG. 5 showing the leading and trailing edges of the printing blanket inserted into the cylinder gap.

FIG. 1 illustrates an embodiment of a printing blanket 3 of the present invention, which shows generally the compressible printing blanket 6, an anti-slip layer 12, and a terminal portion 21 of a metal base plate 9 with a specialized coating layer (shown in FIGS. 2 through 4) applied to the backside thereof, lying in a flattened position. For convenience of understanding the invention, FIGS. 2 through 4 provide greatly exaggerated cross-sectional views of the printing blanket 3 showing the different layers of a preferred embodiment of the invention. These layers, together with their associated features, are discussed below.

For purposes of the present discussion, the terms "bottom" and "lower" and the like are used to refer to that portion of an individual layer or set of layers that is most nearly adjacent to the cylinder upon which the blanket of the present invention is mounted. Conversely, the "top" or "upper" portion of an individual layer or set of layers is that portion thereof which is located or positioned furthest from the printing cylinder.

The lowermost layer of printing blanket 3 is the metal base plate 9, which is formed of thin sheet metal that has been cut in a rectangular shape from a roll of metal. The thickness of the base plate is preferably from 0.05 mm to 1 mm, and most preferably about 0.2 mm to ensure sufficient flexibility. Although stainless steel is a preferred metal for the base plate for purposes of fatigue resistance, high elastic modulus, etc., the invention is not limited to the use of stainless steel for forming the metal base plate 9.

The specialized coating layer 24 is attached to the bottom of the metal base plate 9. When the specialized coating layer 24 is thermowelded to the metal base plate 9, the specialized coating layer 24 preferably has a thickness of from 10 to 250 $\mu$m. The specialized coating layer 24 is generally a thermowelded foil, preferably comprised of polyurethane, polyolefin, phenolic compounds, nylon, polyvinyl chloride, polyvinyl fluoride and mixtures thereof. When the specialized coating layer 24 is applied by coating or spraying a film of solvent and abrasion resistant material, the specialized coating layer 24 has a preferred thickness of from 5 to 50 $\mu$m. The spray on film is preferably comprised of at least one of polyvinyl fluoride (PVF), polytetrafluoroethylene (PTFE), polytetraethylene (PTE), epoxy resins, phenolic resins, and nylon resins. Finally, the specialized coating layer 24 can be applied by plasma treating the metal base plate 9 with silicon carbide or aluminum oxide, or a mixture of them. In this embodiment, the specialized coating layer 24 is applied to a thickness of from 5 to 25 $\mu$m.

In a preferred embodiment of the invention, the metal base plate 9 is at least partially coated with a primer layer 27 that facilitates bonding of the metal base plate 9 to the underside of the compressible printing blanket 6. Before primer layer 27 is applied to metal base plate 9, the top surface of the metal base plate 9 should be cleaned and polished to make the metal flat and to remove grease and oxides for better adhesion. The primer should be a material that is capable of adhering to metal and fabrics. A variety of such materials are well known to those of ordinary skill in this field. A nonlimiting example of a primer that has been found to be particularly useful on base plate is CILBOND 11, produced by Compounding Ingredients Limited, of Preston, England.

The cross-sectional view of FIG. 2 shows the anti-slip layer 12 above the primer layer 27 on metal base plate 9. The metal base plate 9 has a coefficient of friction that would be well known to one of ordinary skill, depending on the metal used. The anti-slip layer 12 has a higher coefficient of friction than that of the metal and is preferably a compounded nitrile rubber. Alternative materials, including other elastomers, may be used for the anti-slip layer 12 as long as they are capable of increasing the coefficient of friction of the top surface of the blanket's leading and/or trailing edges 15 and 18. Moreover, because solvents typically are used to clean printing machinery, the anti-slip layer 12 should be solvent-resistant to maintain friction characteristics.

Anti-slip layer 12 is preferably formed after the compressible printing blanket 6 has been bonded to metal base plate 9 with primer layer 27 and adhesive layer 30. In this preferred embodiment after substantially all of the top surface of the metal base plate 9 is covered with the compressible printing blanket 6, the leading and trailing edges 15 and 18 of blanket are ground down through at least part of the adhesive that binds blanket 6 and base plate 9 together. Thus, when anti-slip layer 12 is formed in this manner, it comprises a portion of adhesive layer 30, as well as, optionally, some of primer layer 27 as illustrated in FIG. 2. Alternative methods of forming the anti-slip layer 12 are described below.

Adhesive shown in FIG. 2 bonds the compressible printing blanket 6 or "carcass" to the metal base plate 9. As noted above, the adhesive layer 30 may be ground down to form anti-slip layer 12 and is preferably a compounded nitrile rubber, but other elastomers may be used in place of nitrile rubber, such as acrylic, urethane, neoprene and fluorocarbon elastomers, if desired.

In a preferred embodiment of the invention, fabric layer 33 forms the lowermost ply and fabric layer 39 form the uppermost ply of the compressible printing blanket 6. Fabric layer 33 is preferred as a means of reducing shear stresses that develop at the interface between the compressible printing blanket 6 and metal base plate 9. Shear stresses arise during operation of the press because the printing blanket is compressed at the nip or print zone between the blanket cylinder and the rigid plate cylinder. At the center of the nip, the blanket is depressed by the cylindrical contour of the printing plate. In the proximate vicinity of the nip, a bulge tends to arise in the printing blanket. Compressible layers have been developed for use in such blankets which minimize the bulges that occur. Nevertheless, bulging and depression of the blanket in the print zone, when present, result in expansion and compression of the printing blanket. Such compression and expansion cause shear stresses at the interface between the printing blanket and the base plate, because the blanket's compressible layer is far more elastic than the metal base plate. Shear stresses have a tendency to cause the printing blanket to delaminate from the metal base plate. Fabric layer 33 reduces this tendency. The embodiment described herein, having one fabric layer 33 below the compressible layer, should not be viewed as limiting the invention since additional fabric layers may be incorporated at this location if desired for a particular application.

Fabric layer 33 may be formed of natural or synthetic material or may be a natural/synthetic blend of an appropriate length and thickness (also referred to as "gauge"). Cotton, polyester, nylon and rayon are typical materials that are commonly used in fabric layers of printing blankets. The thickness of fabric layer 33 ranges from approximately 0.1 mm to 0.4 mm and is most preferably approximately 0.2 mm.

Fabric layer 33, as shown in FIG. 2, abuts a compressible layer 36 which enables the blanket to compress under pressure exerted at the two areas where the printing cylinder and impression cylinder contact the printing blanket 3, to prevent bulging and thus to enhance print quality. Compressible layer 36 comprises a plurality of cells embedded in a binder. Such cells resist the greater and more permanent deformation within blanket that would occur in the absence of such a layer. The binder in which the cells are embedded is made from a suitable resilient polymer matrix, into which a quantity of cell-forming materials are evenly dispersed to form a compound. The cells may be open, e.g., formed by salt leaching; or they may be closed, e.g., formed with the use of, e.g., blowing agents or microspheres. Microspheres, which are the preferred cell-forming material for use in the present invention, are dispersed relatively uniformly throughout the matrix material such that, upon application of the matrix to fabric layer 33, the microspheres become thoroughly embedded in the interstices of the fabric.

Generally, the microspheres are formed from materials such as, e.g., thermoplastic resins, thermosetting resins, ceramics, glass and sintered metals. A preferred thermosetting resin for forming the microspheres used in the invention is a phenolic resin having a density of from about 0.01 to about 0.05 grams per cubic centimeter. The microspheres range in diameter from about 1 to 200 microns, and preferably about 50 to 130 microns, with an average size of about 90 microns being most preferred.

Generally, the microspheres are uniformly distributed throughout the elastomer in such a way as to avoid any appreciable crushing of the microspheres. Additionally, the microspheres are incorporated in the elastomeric material at a loading of about 4–90% and preferably 10–70% of the solids content. This percentage will vary based on such factors as microsphere dimension, wall thickness and bulk density, or if blowing agents are additionally incorporated within the matrix.

To form the cells in the embodiment described above, any of a wide variety of microspheres can be added to a solution or dispersion of the matrix. If solvent solutions are utilized, the selected microspheres must be resistant to chemical attack from the solvents.

Several acceptable types of thermoplastic microspheres useful with the present invention are marketed, for example, by Expancel and Pierce & Stevens. Microspheres of a thermoplastic resin are preferred for this embodiment.

FIGS. 3 and 4 each show alternative embodiments of the present invention utilizing additional fabric layers that can be added to increase the blanket's overall thickness, or to decrease the shear stresses that are experienced by a given part of the blanket. In FIG. 3, the additional fabric layer 45 can be seen between the upper printing face 42 and the compressible layer 36. Positioning a second fabric layer in this orientation can decrease the shear stresses between the printing face and the compressible layer. The additional fabric layer is bound to the upper fabric layer 39 by an adhesive layer 48.

FIG. 4 shows an alternative embodiment where an additional fabric layer 51 is inserted between the metal base plate 9 and the compressible layer 36. This additional fabric layer 51 is provided to decrease the shear forces between the base plate 9 and the compressible layer 36. The additional fabric layer 51 is bound to the lower fabric layer 33 by an adhesive layer 54.

In the embodiments of FIGS. 3 and 4, an adhesive (not indicated in the drawings) is provided between compressible layer 36 and fabric layer 33. Adhesive may be applied to either or both compressible layer 36 and fabric layer 33 before these layers are laminated together. Alternatively or additionally this bonding may be effected by a chemical reaction that occurs between compressible layer 36 and fabric layer 33 during the curing process. The adhesive is typically nitrile rubber, as described above.

The embodiment of FIG. 3 has one or more fabric layers such as fabric layers 39 and 45 positioned between compressible layer 36 and the printing face 42. This top fabric layer or fabric layer stack serves to stabilize the interface between compressible layer 36 and upper printing face 42 during printing operations. Upper printing face 42 is an elastomeric compound which is adapted to accept the print image from the printing plate and transfer it to a substrate such as paper. Upper face 44 of upper printing face 42 may be buffed to a desired surface roughness profile in a known manner to improve print quality and to facilitate release of the web.

To make the printing blanket 3 according to a preferred mode of the invention, the fabric layer 33 is first coated by spreading with an elastomeric compound such as nitrile rubber to bond compressible layer 36 atop fabric layer. The elastomer coated fabric is cured according to conventional methods, such as festooning, and is then buffed or ground to a desired thickness from 0.5 mm to 1.0 mm, preferably from 0.6 mm to 0.7 mm, and optimally about 0.66 mm. Adhesive, e.g., nitrile rubber, may be spread over the top of compressible layer 36 to adhere an additional fabric layer. Additional adhesive (e.g., nitrile rubber) is spread on the bottom surface of another layer of fabric, which is laminated on top of compressible layer 36. Elastomeric printing face 42 is applied to the top of the carcass, which is then cured and ground again, so that the thickness of upper face ranges from approximately 0.2 mm to 0.5 mm, preferably 0.3 mm to 0.4 mm and most preferably about 0.35 mm thick. The bottom of the carcass, after curing, is spread with nitrile rubber adhesive 30 to facilitate attachment to the metal base plate 9 through the primer layer 27 placed thereupon.

Meanwhile, metal base plate 9 is cut to the desired dimensions and polished on its upper surface to remove oxides and grease. The top surface is coated with a primer that aids in bonding metal to elastomeric material. Metal plate 9 is then pressed or laminated onto the prepared carcass of compressible printing blanket 6. The preferred thickness of the entire blanket ranges from approximately 1 mm to 3 mm, more preferably 1 mm to 2 mm and optimally about 1.61 mm.

To form anti-slip layer 12 according to a preferred mode of the invention, the edges of compressible printing blanket 6 near leading and trailing edges 15 and 18 and of metal base plate 9 are ground down until a very thin layer of cured adhesive remains on the leading and trailing edges 15 and 18. In an alternative embodiment, however, the leading and trailing edges 15 and 18 of metal base plate 9 may initially be left bare. Anti-slip layer 12 may thereafter be added to the exposed metal edges, e.g., by spraying or brushing onto the edges, optionally with an adhesive, after the carcass and metal base plate 9 are laminated together.

Turning to FIG. 3, in a further embodiment, sealant 66 is applied along the edges of blanket between the blanket and bare edge to keep various fluids such as ink, water and solvents typically encountered in a printing environment from penetrating the multiple layers of the blanket and causing swelling and delamination of the various layers. The sealant 66 should be resistant to such solvents, including those used for cleaning the blanket, and is preferably a nitrile polymer such as EC 776, produced by 3M. Other materials that may be used as sealants 66 include but are not limited to acrylic polymers, fluorocarbon polymers, urethane polymers, cyanoacrylate polymers, epoxy polymers or other solvent-resistant polymers and mixtures thereof.

Terminal portions 21 of printing blanket 3 are preferably formed by covering the ends of the edges with adhesive tape before primer is applied to the upper surface of the metal plate. The tape prevents primer from coating the sides and/or bottom of the plate during application of the primer. The tape is removed after anti-slip layer 12 is formed or applied, leaving a narrow edge that is less than 10% of the distance between the leading or trailing edges 15 and 18 of metal base plate 9 and compressible printing blanket 6. The smooth metal edges of terminal portions 21 facilitate the insertion of leading and trailing edges 15 and 18 into the cylinder gap 60.

Once leading and trailing edges 15 and 18 are properly oriented, printing blanket 3 is ready for mounting on the blanket cylinder 57, which is rotatable about spindle 63, by conventional methods for metal-backed blankets. The blanket is wrapped around the cylinder so that the upper surface of leading and trailing edges 15 and 18 of the printing blanket 3 face each other. Leading and trailing edges 15 and 18 are inserted into cylinder gap 60 wherein they may be pressed together by (optional) conventional spring-loaded clamping means 69. Anti-slip layers 12 abut each other inside the cylinder gap 60 and reduce slippage between leading and trailing edges 15 and 18 during operation.

It is possible to position the compressible layer 36 just below the printing face 42. The number of fabric layers can differ. This can depend on the total thickness of the final blanket and on the characteristics required to the final production.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A metal backed printing blanket for mounting on a blanket cylinder that includes a gap, said printing blanket comprising:

a thin metal base plate having a top surface and a bottom surface and ends which include leading and trailing edges adapted for engaging said cylinder gap;

a compressible, elastomeric printing blanket secured to the top surface of the base plate but not to the ends, and having an upper face adapted for contact transfer of ink to a printable substrate; and a specialized coating having a thickness of from about 5 to about 250$\mu$ applied by plasma treatment to said bottom surface to prevent deformation of said printing blanket and to prevent delamination of said printing blanket from the blanket cylinder, wherein said specialized coating is selected from the group consisting of silicon carbide, aluminum oxide, or a mixture thereof.

2. The compressible printing blanket of claim 1, wherein said specialized coating has a thickness of from 5 to 25 $\mu$m.

3. The metal backed printing blanket according to claim 1, wherein an anti-slip layer is provided upon at least a portion of the top surface of each end of said base plate, with said anti-slip layers facing each other with the base plate ends positioned in the cylinder gap to provide more secure retention of the base plate within the gap during rotation of the cylinder.

4. The metal-backed printing blanket according to claim 1, further comprising a sealant applied along the edges of the blanket to prevent entry of liquid therein.

5. The metal-backed printing blanket according to claim 4, wherein the sealant is a material selected from the group consisting of nitrile polymers, acrylic polymers, fluorocarbon polymers, urethane polymers, cyanoacrylate polymers, epoxy polymers and mixtures thereof.

6. The metal-backed printing blanket according to claim 1, wherein said printing blanket further comprises at least one compressible layer beneath the upper face and at least one fabric layer to stabilize an interface or to reduce shear forces between the upper face or lower face and the compressible layer.

7. A method of making a printing blanket for mounting on a cylinder that includes a gap, which comprises:

applying an elastomeric printing blanket upon a metal base plate that has top and bottom surfaces and ends which include leading and trailing edges adapted for engaging the cylinder gap; and applying a specialized coating having a thickness of from 5 to 50 $\mu$m by spray-on techniques to said bottom surface to prevent deformation of said printing blanket and to prevent delamination of said printing blanket from the blanket cylinder;

wherein said specialized coating is selected from the group consisting of polyvinyl fluoride, polytetrafluoroethylene, polytetraethylene, epoxy resins, phenolic resins, nylon resins, and combinations thereof.

8. The method according to claim 7, wherein an anti-slip layer is provided upon at least a portion of the top surface of each end of said base plate, with said anti-slip layers facing each other with the base plate ends positioned in the cylinder gap to provide more secure retention of the base plate within the gap during rotation of the cylinder.

9. The method according to claim 7, further comprising sealing the edges of the blanket by applying a sealant to prevent entry of liquid therein.

10. The method according to claim 9, wherein said sealant is a material selected from the group consisting of nitrile polymers, acrylic polymers, fluorocarbon polymers, urethane polymers, cyanoacrylate polymers, epoxy polymers and mixtures thereof.

11. The method according to claim 7, said method further comprising providing at least one compressible layer beneath the upper face and at least one fabric layer to stabilize an interface or to reduce shear forces between the upper face or lower face and the compressible layer.

12. A method of making a printing blanket for mounting on a cylinder that includes a gap, which comprises:

applying an elastomeric printing blanket upon a metal base plate that has top and bottom surfaces and ends which include leading and trailing edges adapted for engaging the cylinder gap; and applying a specialized coating having a thickness of from 5 to 25 $\mu$m to said bottom surface by thermowelding to prevent deformation of said printing blanket and to prevent delamination of said printing blanket from the blanket cylinder;

wherein said specialized coating is selected from the group consisting of silicon carbide, aluminum oxide, or mixtures thereof.

13. The method according to claim 12, wherein an anti-slip layer is provided upon at least a portion of the top surface of each end of said base plate, with said anti-slip layers facing each other with the base plate ends positioned in the cylinder gap to provide more secure retention of the base plate within the gap during rotation of the cylinder.

14. The method according to claim 12, further comprising sealing the edges of the blanket by applying a sealant to prevent entry of liquid therein.

15. The method according to claim 14, wherein said sealant is a material selected from the group consisting of nitrile polymers, acrylic polymers, fluorocarbon polymers, urethane polymers, cyanoacrylate polymers, epoxy polymers and mixtures thereof.

16. The method according to claim 12, said method further comprising providing at least one compressible layer beneath the upper face and at least one fabric layer to stabilize an interface or to reduce shear forces between the upper face or lower face and the compressible layer.

* * * * *

UNITED STATES PATENT AND TRADEMARK OFFICE

CERTIFICATE OF CORRECTION

PATENT NO. : 6,912,955 B2
APPLICATION NO. : 10/645106
DATED : July 5, 2005
INVENTOR(S) : Gianpietro Invernizzi et al.

It is certified that error appears in the above-identified patent and that said Letters Patent is hereby corrected as shown below:

Column 9, line 46

Claim 1, “to about 250 u” should read --to about 25 um--

Column 9, lines 53-54

Claim 2 should be deleted.

Column 10, line 54

Claim 12, “by thermowelding to” should read -- by plasma treatment to --

Signed and Sealed this

Twenty-ninth Day of July, 2008

JON W. DUDAS
*Director of the United States Patent and Trademark Office*